US005919089A

United States Patent [19]

Rosati

[11] Patent Number: 5,919,089

[45] Date of Patent: Jul. 6, 1999

[54] FIFTY FIVE-SEVENTY (55-70) ROMAN STUD I, II, AND ROMAN PLEASURE

[76] Inventor: Marco Rosati, 1913 Summerplace Dr., West Covina, Calif. 91792

[21] Appl. No.: 08/661,006

[22] Filed: Jun. 10, 1996

[51] Int. Cl.[6] ..... A63F 3/00

[52] U.S. Cl. ..... 463/12; 463/16; 273/292; 273/138.2; 273/139

[58] Field of Search ..... 463/1, 12–13, 463/30–31, 36, 40; 364/410, 412; 273/274, 138.1, 139, 138.2, 292–293, 303–306, 309, 149 R

[56] References Cited

U.S. PATENT DOCUMENTS

| | | | |
|---|---|---|---|
| 3,689,071 | 9/1972 | Kucera | 273/292 |
| 3,796,433 | 3/1974 | Fraley et al. | 273/292 |
| 4,497,488 | 2/1985 | Plevyak et al. | 273/149 R |

*Primary Examiner*—Jessica Harrison
*Assistant Examiner*—Mark A. Sager
*Attorney, Agent, or Firm*—Joseph E. Mueth

[57] ABSTRACT

Playing card games, designed and played with a newly set of cards (two decks of fifty-two cards each), having different values and different suits. The suits of this newly designed set of cards are Double Hearts, Double Clubs, Double Spades, Double Diamonds. Each suit of the first deck, (FIGS. 1 to 4), contains 13 cards bearing the number 0, 10, 11, 12, 13, 14, 15, 16, 17, 18, 19, 20, 21. The value of the cards is their face values except for cards bearing numbers 11, 17, 19, 20, which have value of 10 each per suit. Thus, each suit contains 5 cards with a value of 10 each, and 8 cards with a value of 0, 12, 13, 14, 15, 16, 18 and 21. The first deck is the primary deck, with which all the games are played. Each suit of the second deck, (FIGS. 5 to 8), contains 8 cards with a value of 10 each, 4 cards each, with a value of 15, 16, 18, 21 and a Joker. The second deck is used only in those games which feature a Super Jackpot. All the games present are played by adding the value of the cards of the identical suits.

20 Claims, 13 Drawing Sheets

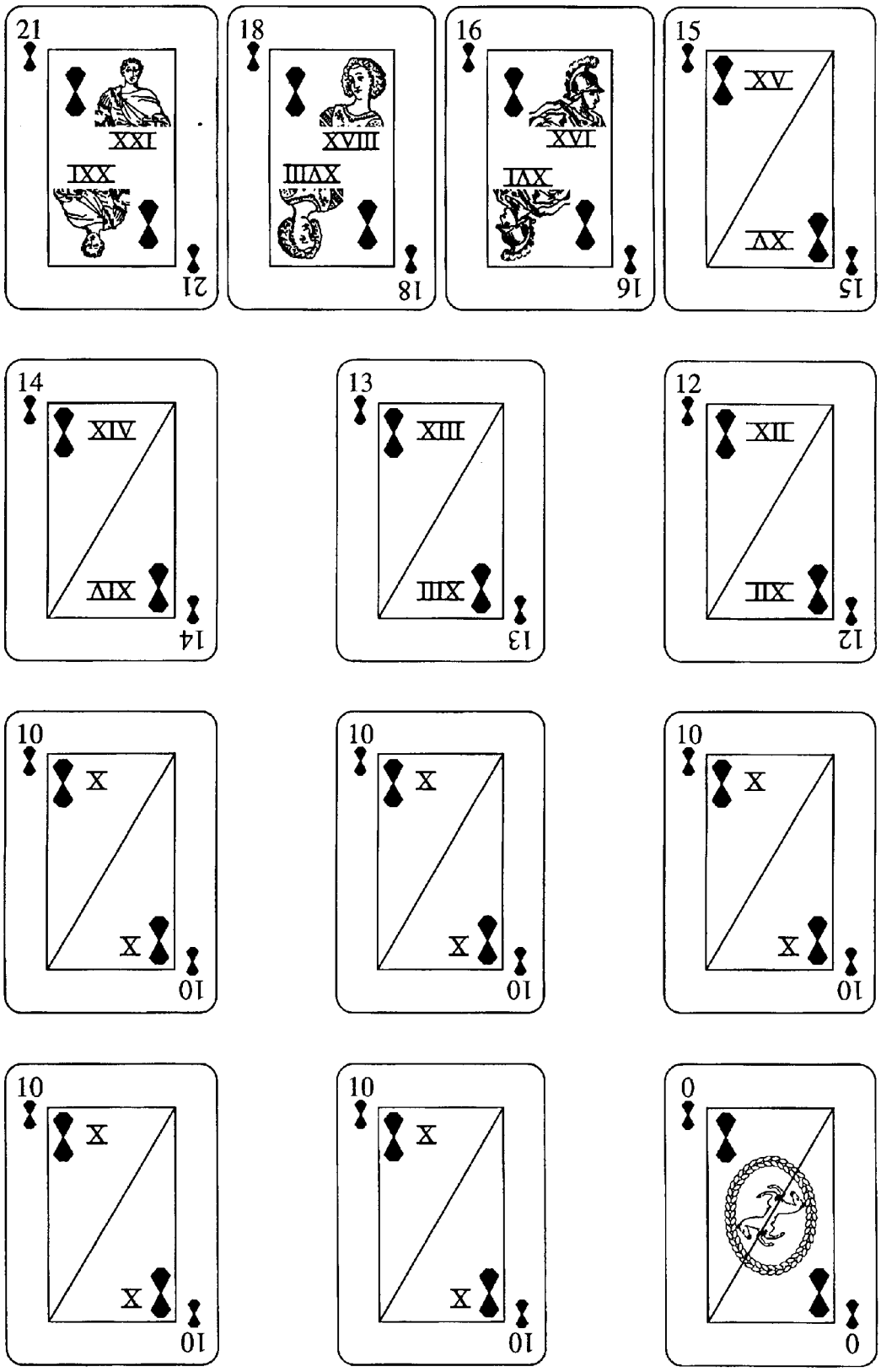
- FIG. 1 -

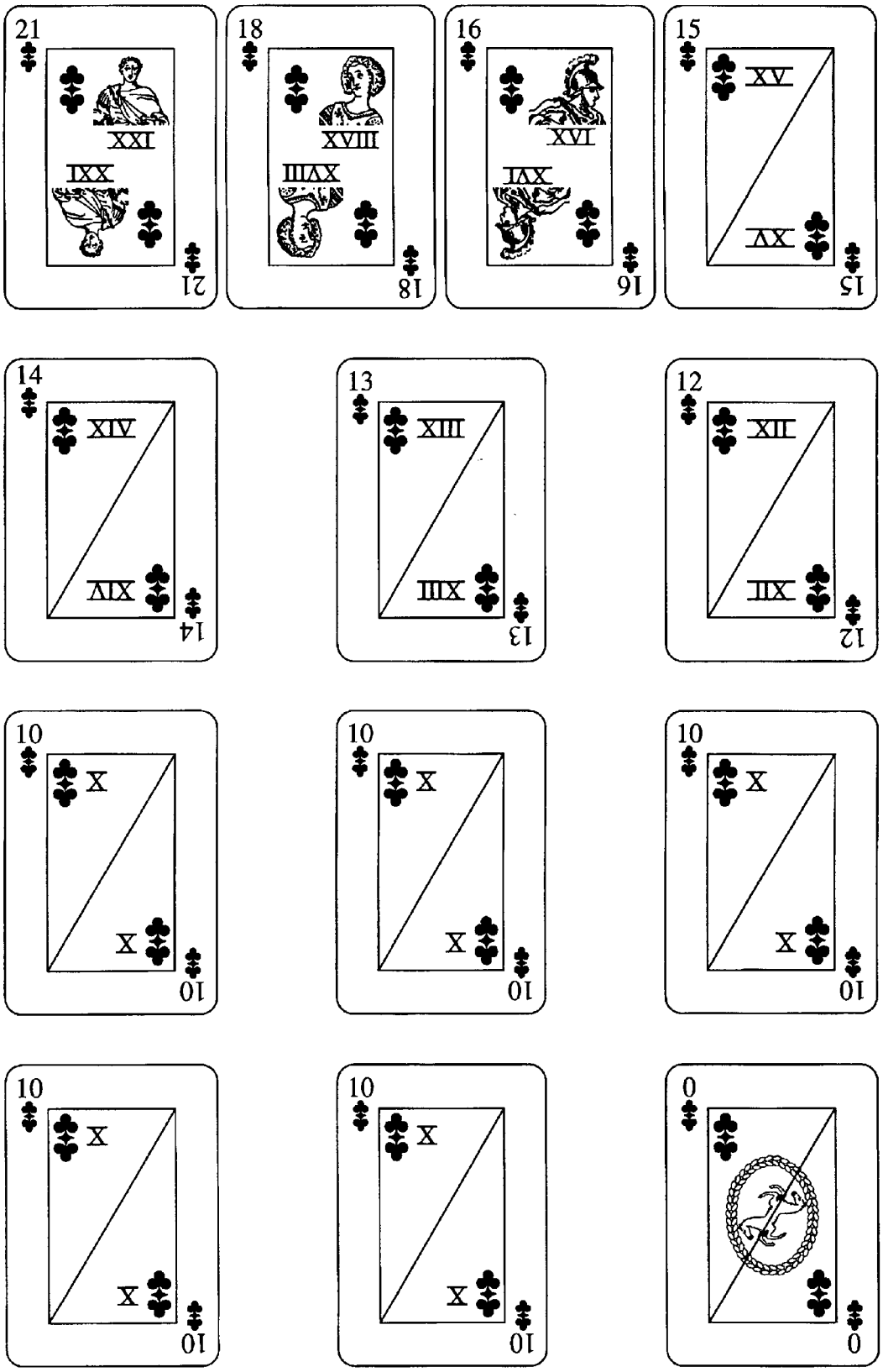
- FIG. 2 -

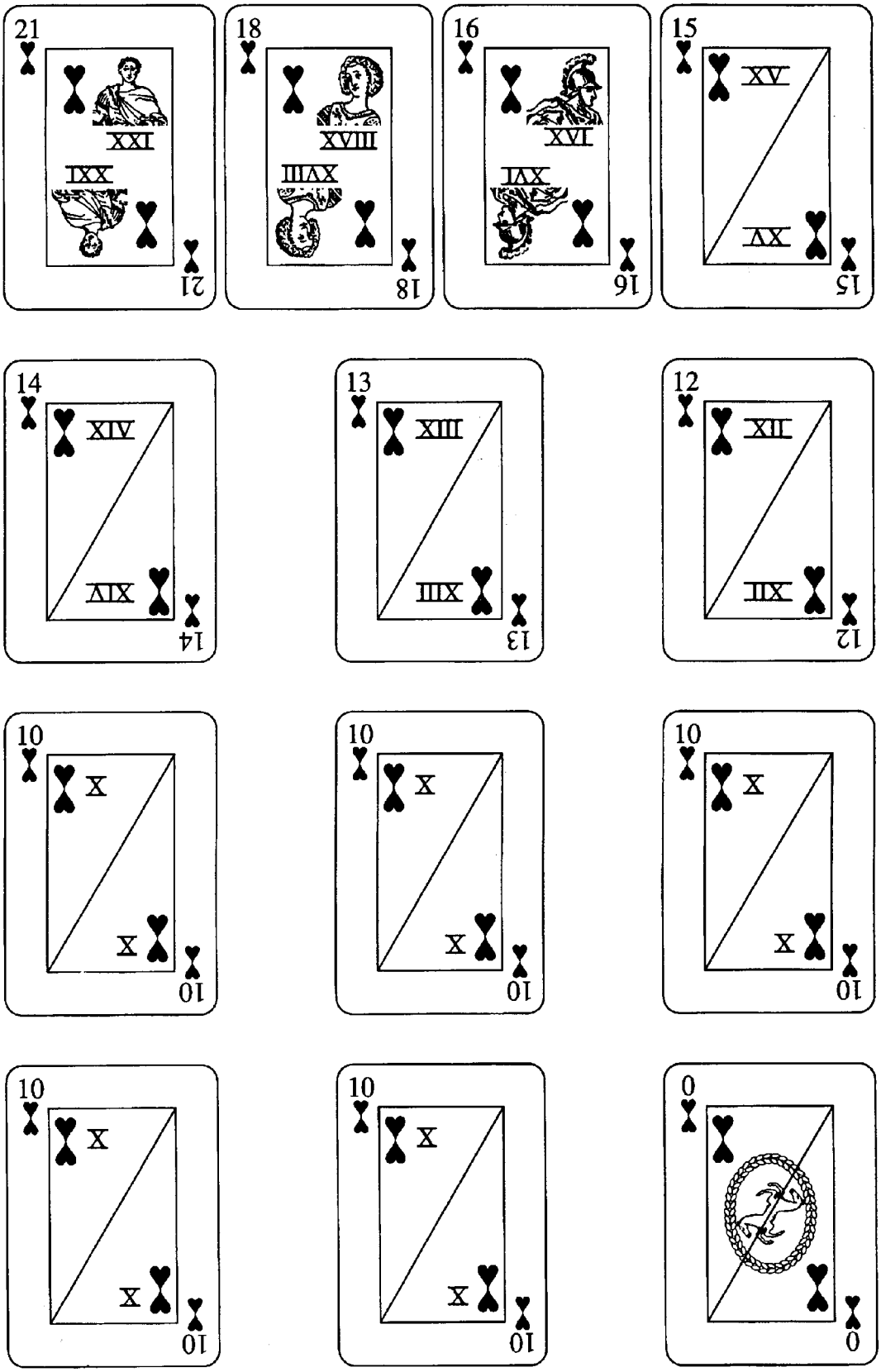
- FIG. 3 -

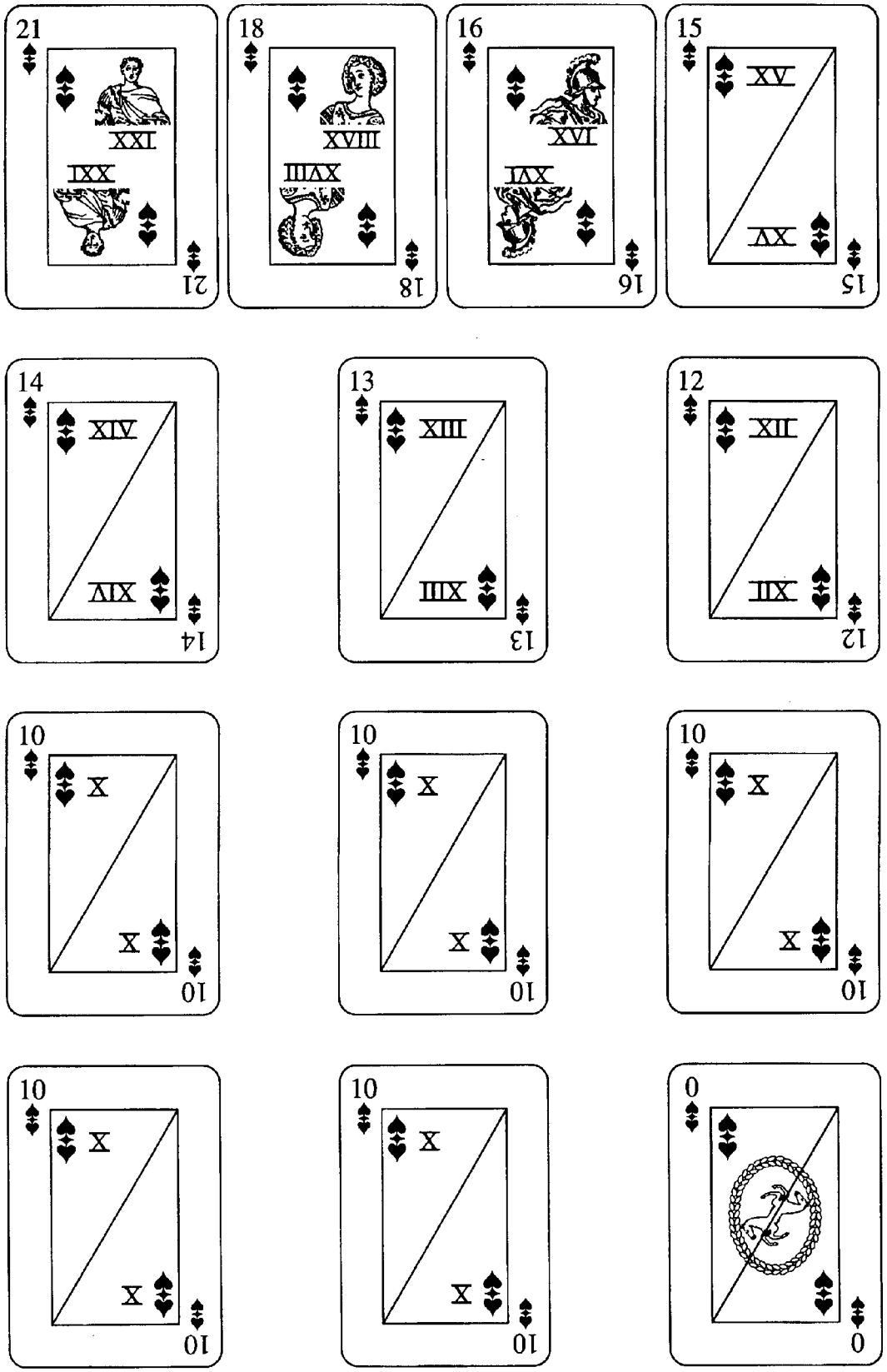
- FIG. 4 -

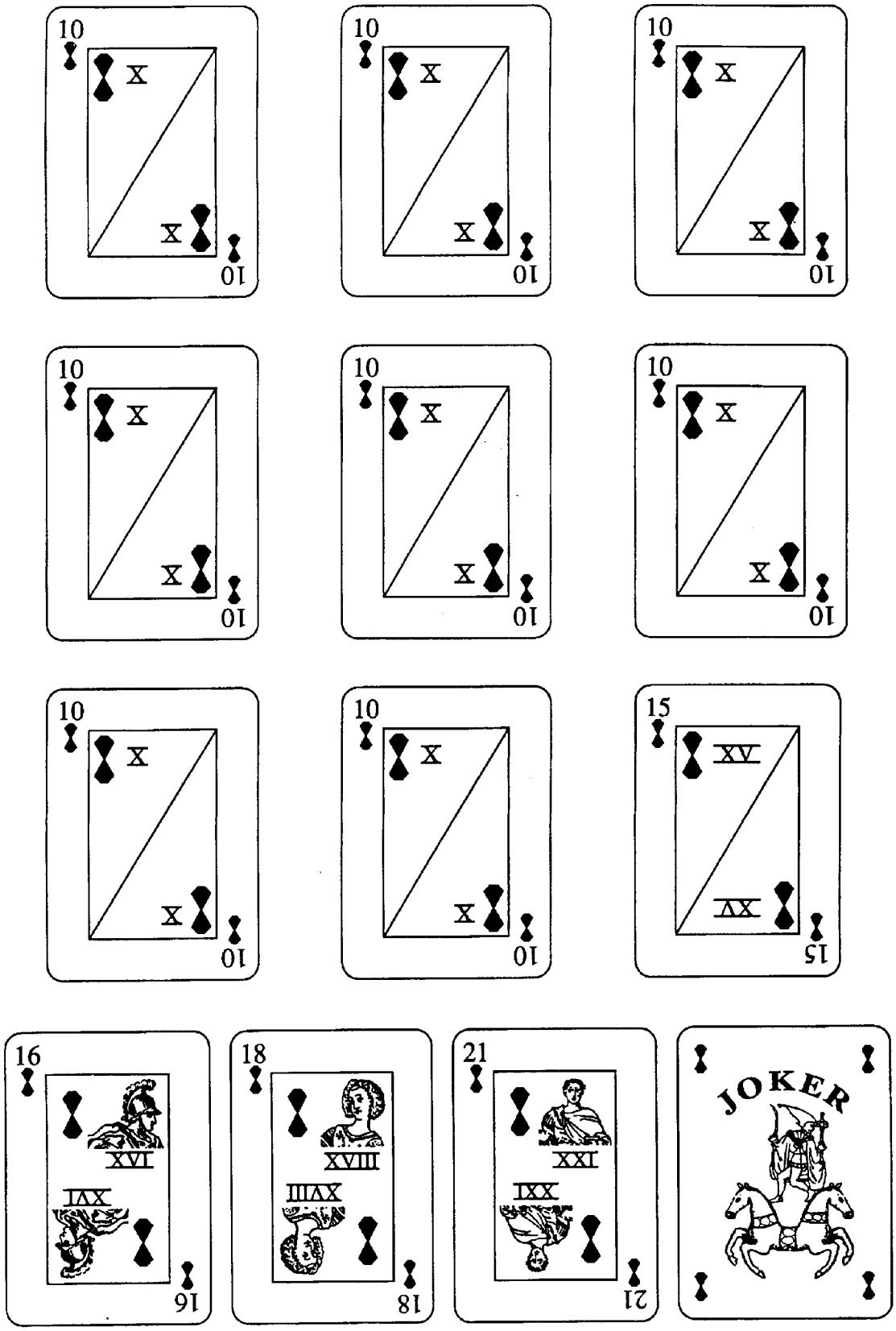
- FIG. 5 -

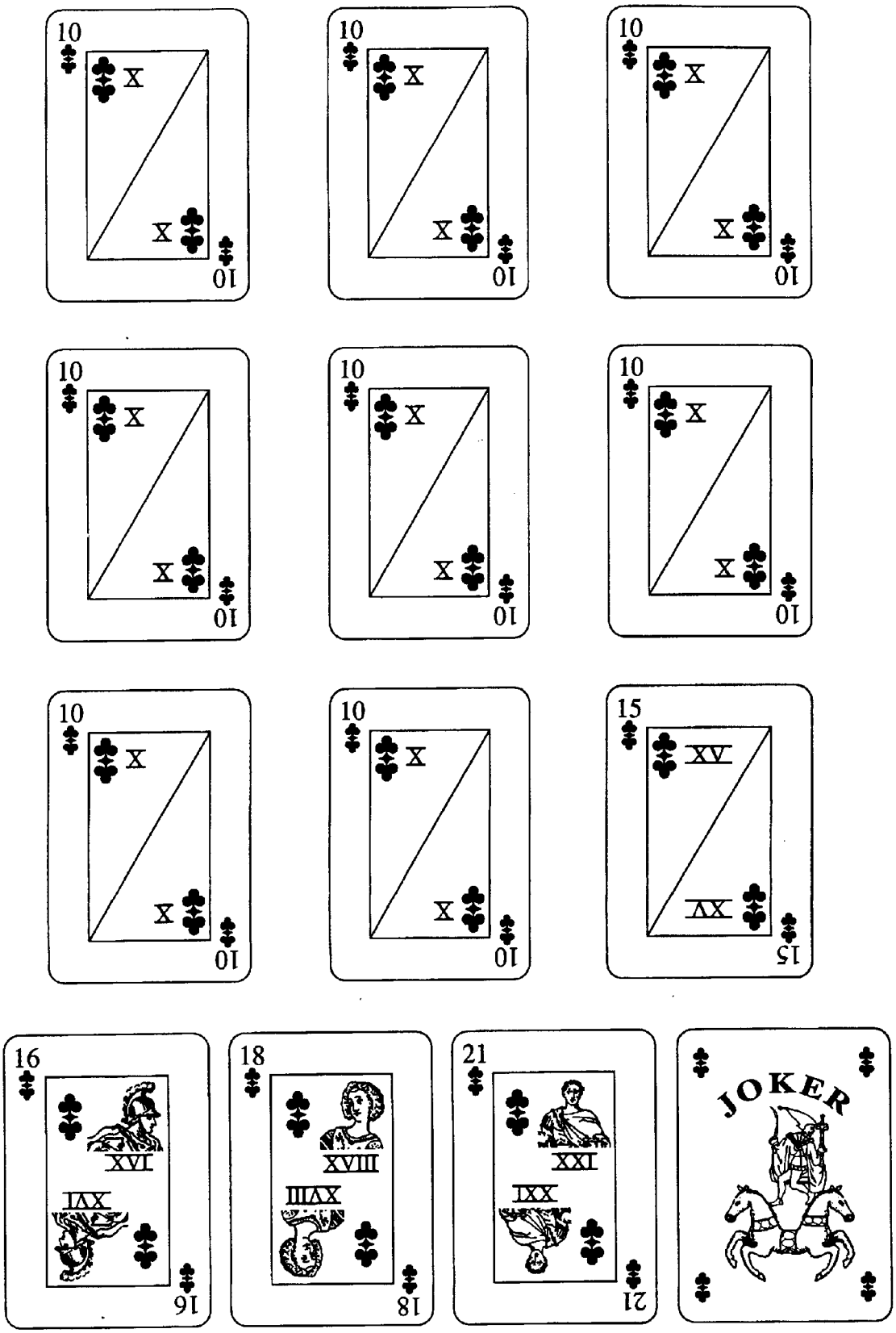
- FIG. 6 -

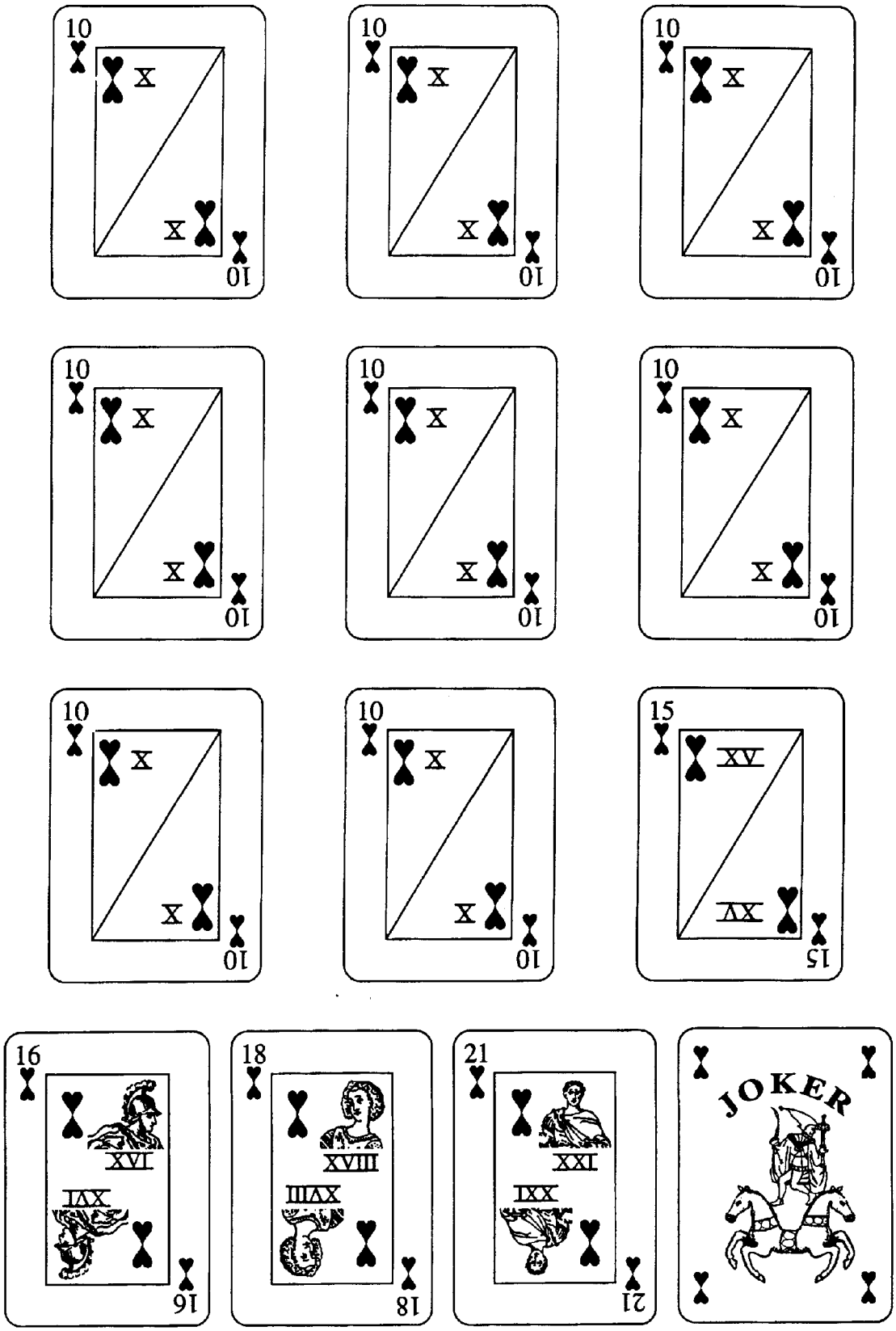
- FIG. 7 -

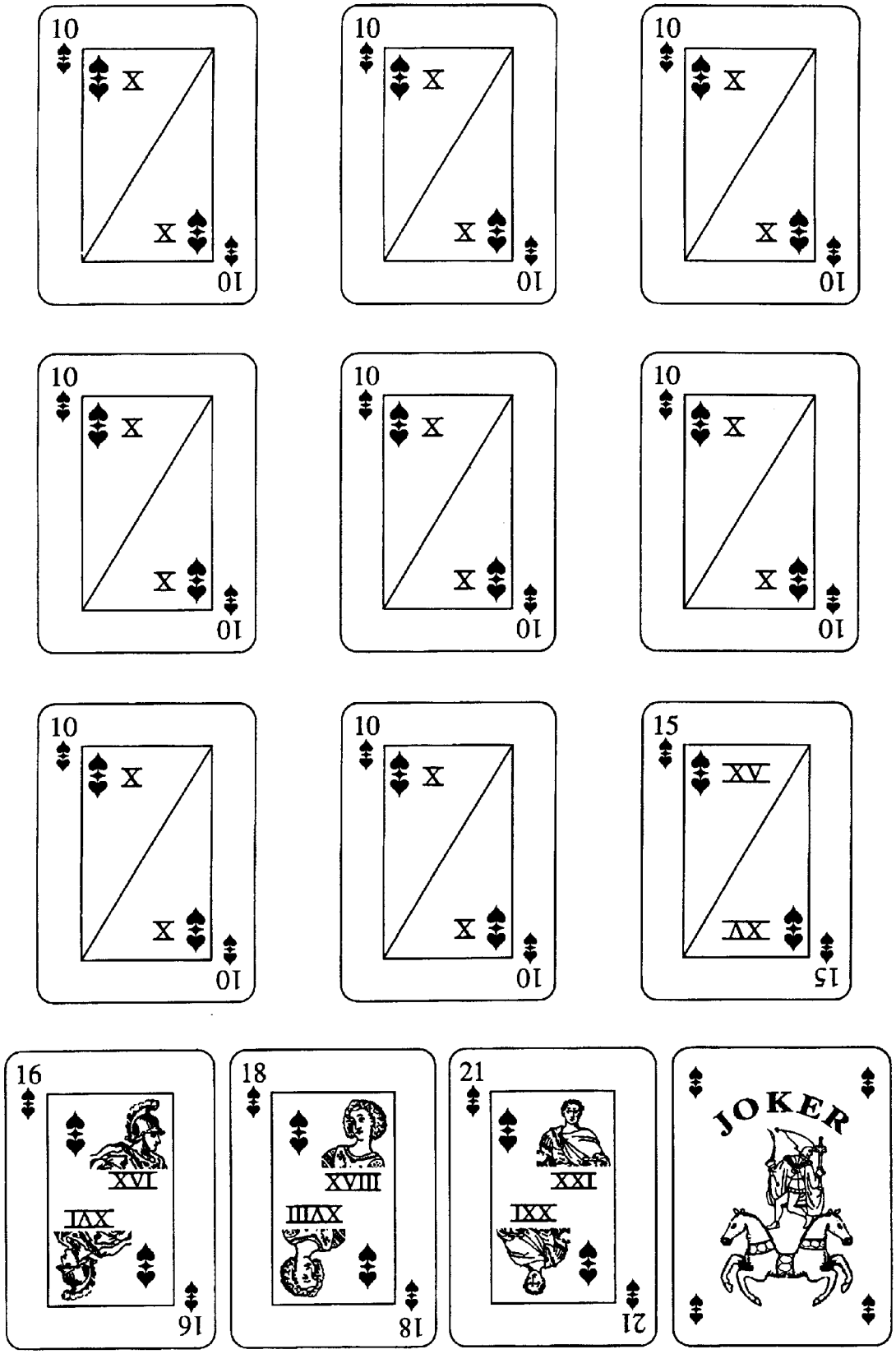
- FIG. 8 -

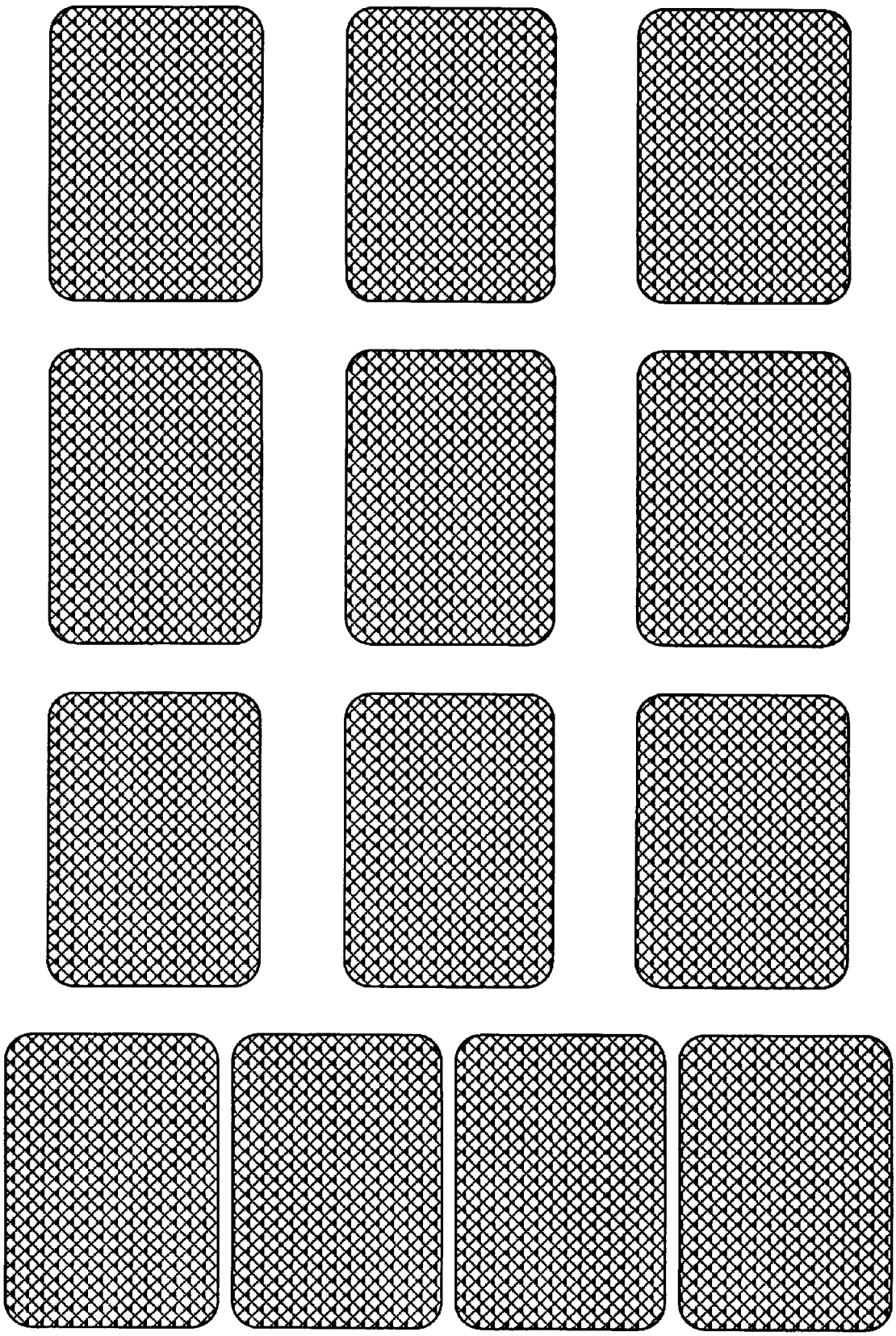
- FIG. 9 -

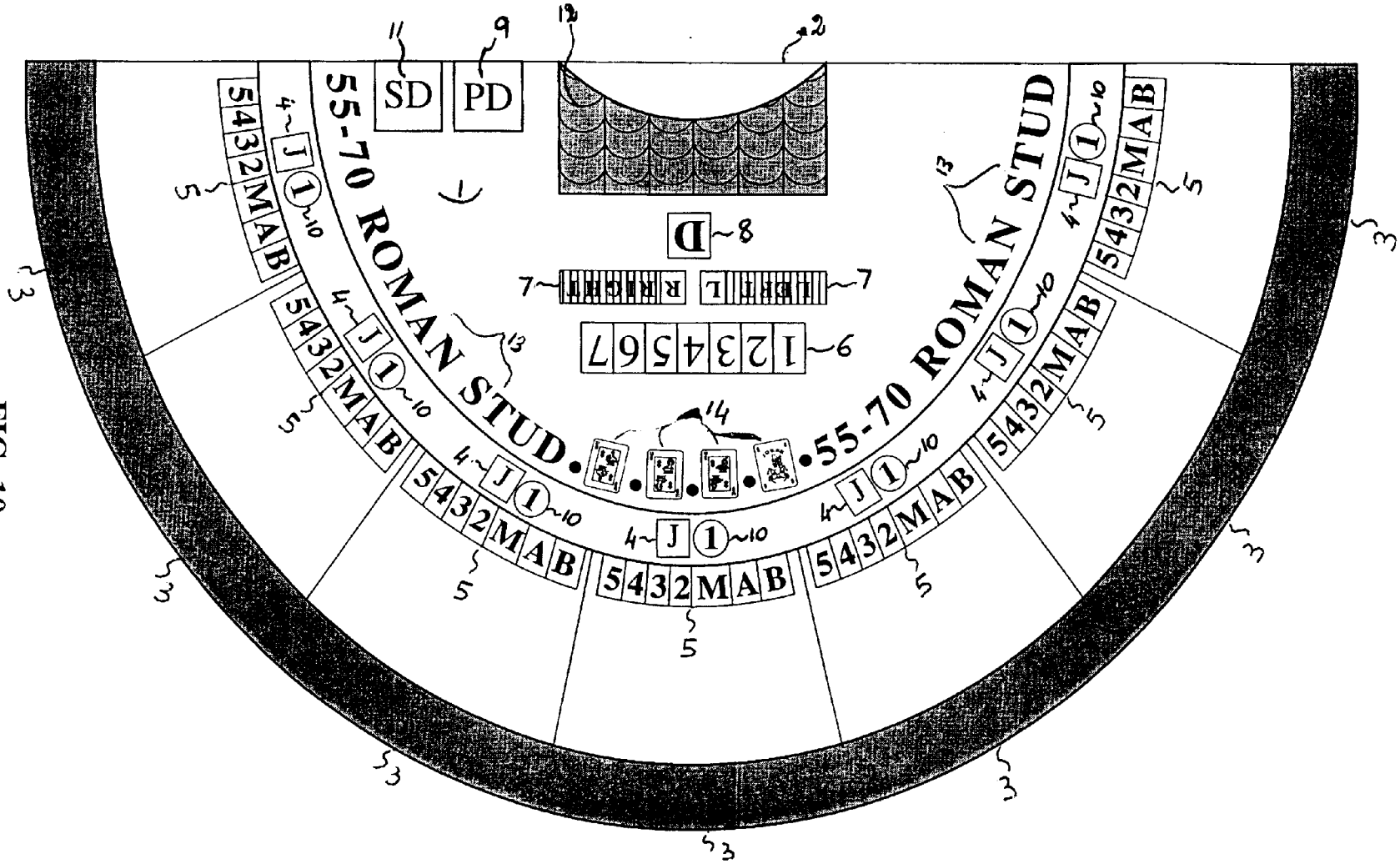
- FIG. 10 -

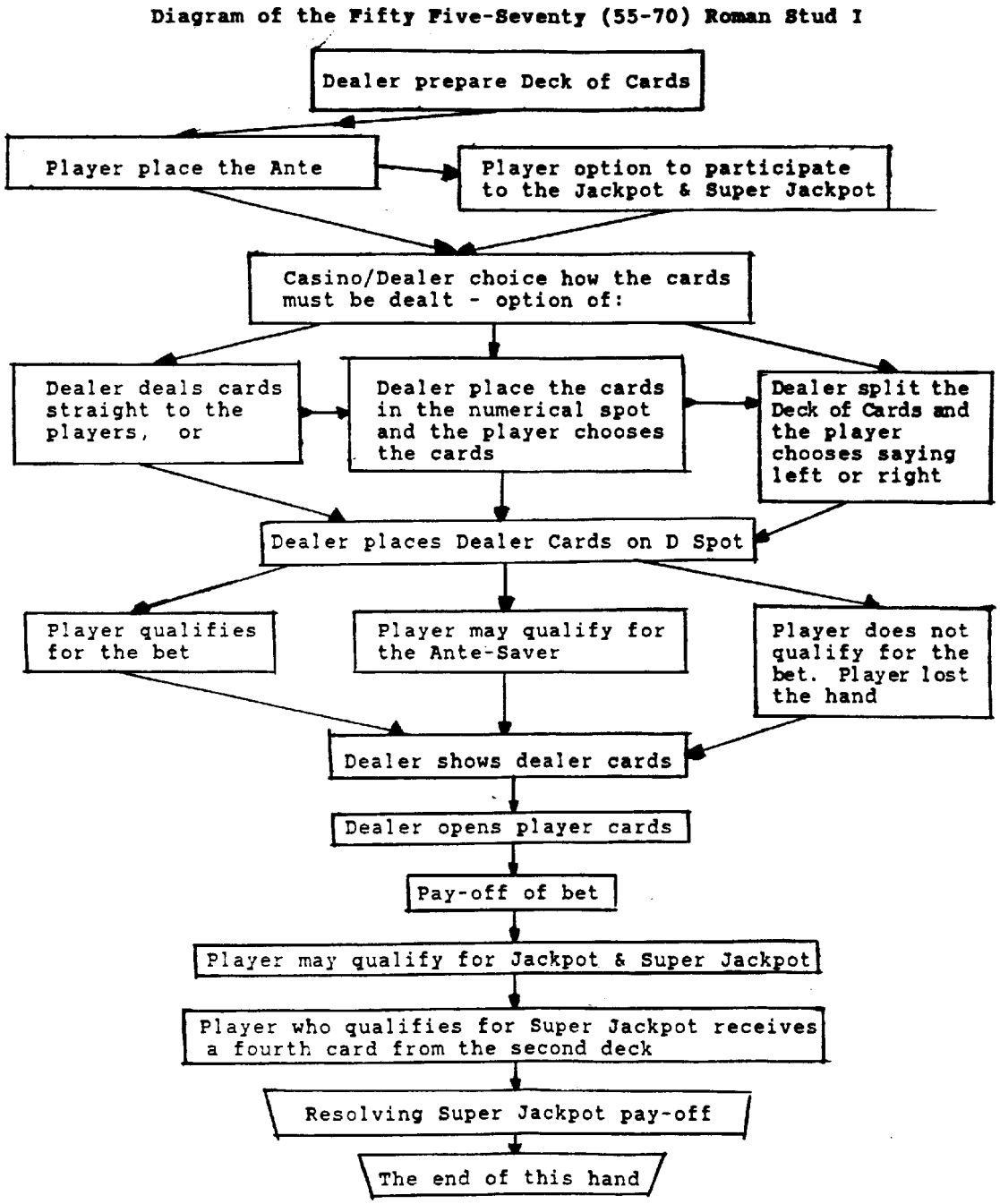
- FIG. 11 -

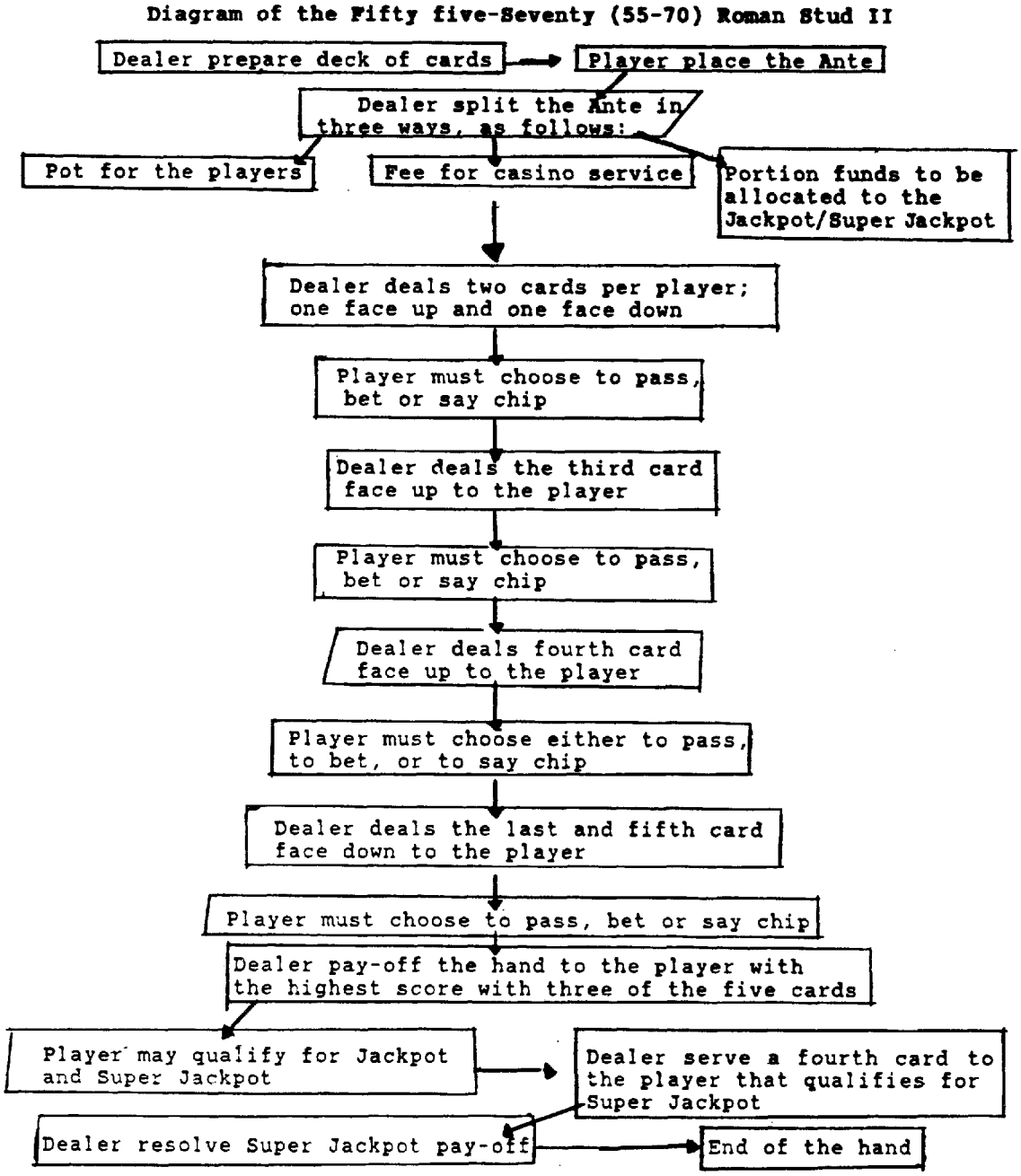
The same diagram plan may be used for the game Roman Pleasure
- FIG. 12 -

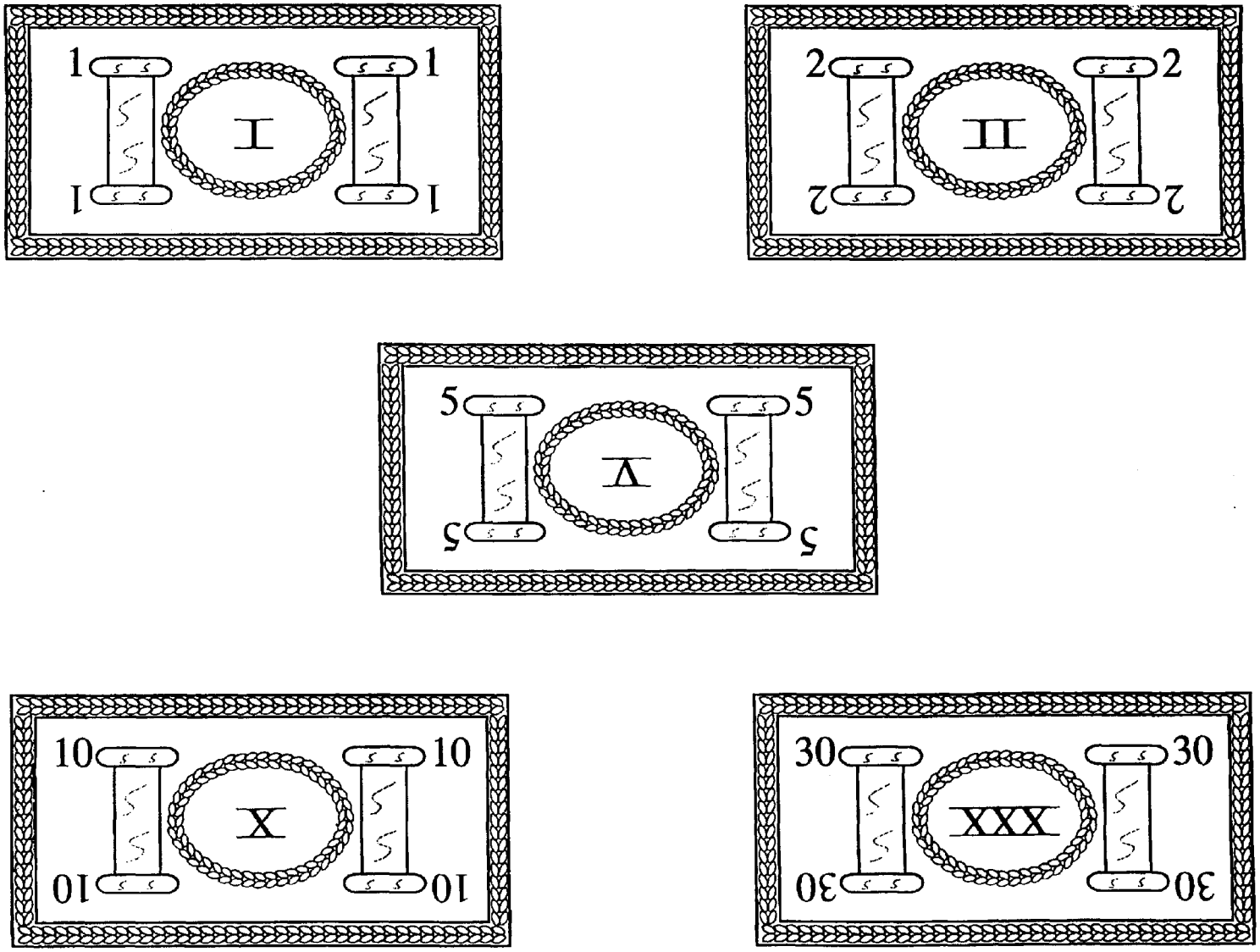
- FIG. 13 -

FIFTY FIVE-SEVENTY (55-70) ROMAN STUD I, II, AND ROMAN PLEASURE

BACKGROUND OF INVENTION

A wide variety of card games and card game methods are known. In recent years, several new playing card game methods have been proposed, for example, in Breeding, U.S. Pat. No. 5,288,081, Kangsanaraks, U.S. Pat. No. 5,366,228, Shen et al., U.S. Pat. No. 4,659,087, Cabot, et al., U.S. Pat. No. 5,322,295, Wood, U.S. Pat. No. 4,651,997, Marquez, U.S. Pat. No. 5,288,082, Jones, U.S. Pat. No. 5,288,077, Cauda, U.S. Pat. No. 5,320,356, Tomaszewski, U.S. Pat. No. 5,013,049, and Ferrer, U.S. Pat. No. 5,314,193. These games are played with a standard fifty-two card deck. With the increasing prevalence of legalized gambling, a need has arisen for new card game methods to rekindle player interest and provide casino operators the basis for promotional endeavors touting novel playing experiences.

The present invention provides novel playing card games using new deck of cards having different values and different suits. The deck is composed of 52 cards and 4 suits. The suits are double hearts, double spades, double diamonds, double clubs, or triple hearts, triple spades, triple diamonds, triple clubs, etc. Each suit contains 13 cards bearing the numbers 0, 10, 11, 12, 13, 14, 15, 16, 17, 18, 19, 20, 21. The value of cards is their face value except for cards bearing numbers 11, 17, 19, 20, which have a value of 10 each per suit. Thus, each suit contains 5 cards with a value of 10 each, and 8 cards with values of 0, 12, 13, 14, 15, 16, 18, and 21. The values of the cards are additive only if the cards are of the same suit. A number of new and stimulating games can be played using the novel deck of cards as will be explained hereinbelow. A second novel deck is used in several of the games.

SUMMARY OF INVENTION

Briefly, the present invention comprises a method of playing a card game (Roman Stud I) with a deck of cards composed of 52 cards and 4 suits, the suits being double (or higher multiples) hearts, double (or higher multiples) spades, double (or higher multiples) diamonds and double (or higher multiples) clubs, each suit containing 13 cards bearing the numbers 0, 10, 11, 12, 13, 14, 15, 16, 17, 18, 19, 20 and 21, the value of the cards being their face value except for cards bearing numbers 11, 17, 19 and 20 which have a value of 10 each per suit, the values of the cards being additive only if the cards are of the same suit, an ante being made prior to the examination of any card, comprising the steps of:

A. forming dealer and player hands each containing three cards;

B. each of the players examines his hand and totals the value of the cards of the same suit;

C. eliminating from the bidding any player having a total of less than 28; and

D. declaring winners only those remaining players having a total of 28 or more and exceeding the dealer's total.

Any player may qualify for a Super Jackpot by one of the following combinations from the same suit:

| | | | |
|---|---|---|---|
| 12-16-21 = 49 | 10-18-21 = 49 | 13-15-21 = 49 | 15-16-18 = 49 |
| 13-18-21 = 52 | 15-16-21 = 52 | 15 18 21 = 54 | 16-18-21 = 55; |

after scoring one of the above combinations, the player receives a fourth card from a second deck, said second deck having 52 cards with 4 suits, each suit contains 8 cards with a value of 10 each, 4 cards with values of 15, 16, 18, 21, and a Joker, the suits being the same as the first deck, if the fourth card is of the same suit and the value of which is such that when added to the first three cards, the resulting total is 70, the player wins a portion of the Super Jackpot. Any player having the combination from the same suit: 16–18–21=55 qualifies for the Total Super Jackpot. The player holding this combination then receives a fourth card. If that card is a Joker of the same suit, the player wins the Total Super Jackpot.

This invention further includes a method of playing a card game (Roman Stud II) with a deck of cards composed of 52 cards and 4 suits, the suits being double (or higher multiples) hearts, double (or higher multiples) spades, double (or higher multiples) diamonds and double (or higher multiples) clubs, each suit containing 13 cards bearing the numbers 0, 10, 11, 12, 13, 14, 15, 16, 17, 18, 19, 20 and 21, the value of the cards being their face value except for cards bearing numbers 11, 17, 19 and 20 which have a value of 10 each per suit, the values of the cards being additive only if the cards are of the same suit, 5 cards being presented to each player as follows: first card face down, second, third, and fourth cards face up and fifth face down, an ante being made prior to the dealing of any cards, comprising the steps of:

A. each player receiving the first 2 cards the first face down, and the second face up;

B. starting the bet with the player with the lowest card value having the option of choosing from the following: bet, pass or chip, with the following consequences,
   1. when a player chooses to pass, he is out of the hand, and he lost the ante,
   2. when the player chooses to say chip is still in the game, and he may re-enter in that hand any time any other player chooses to bet,
   3. when the player chooses to bet, he qualifies for the next card, C. options 1, 2, and 3, of step B are repeated for the second, third, fourth and fifth cards per each hand, and D. declaring the player that scores the highest value with three of the five cards the winner of the pot.

Still further, the present invention provides a method of playing a card game (Roman Pleasure) with a deck of cards composed of 52 cards and 4 suits, the suits being double (or higher multiples) hearts, double (or higher multiples) spades, double (or higher multiples) diamonds and double (or higher multiples) clubs, each suit containing 13 cards bearing the numbers 0, 10, 11, 12, 13, 14, 15, 16, 17, 18, 19, 20 and 21, the value of the cards being their face value except for cards bearing numbers 11, 17, 19 and 20 which have a value of 10 each per suit, the values of the cards being additive only if the cards are of the same suit, comprising the steps of:

A. establishing a source of paper chips having point values as follows:
   10 chips with values of 30 points
   30 chips with values of 10 points
   40 chips with values of 5 points
   50 chips with values of 2 points
   100 chips with values of 1 point, B. the players dividing the paper chips in equal parts as follows: 1 chip of 30 points; 3 of 10; 4 of 5; 5 of 2; 10 of 1 point each, C. each player being provided with 5 cards, but only the best of 3 of the 5 of the same suit being additive.

D. to play, each player opens the game with an ante of at least 3 points, and

E. declaring the winner the player scoring more than any other player.

The Fifty Five-Seventy (55-70) Roman Stud I is played against dealer who provides three cards per player and three cards to dealer, having each participant add the value of the cards of the same suit. The methods of this game is designed to be more involving of the player, giving the player more options and more control, even if the odds are favoring the casino.

The Fifty Five-Seventy (55-70) Roman Stud II is played player against player with the dealer serving as a judge, providing 5 cards per player(s) with only three of the five cards being additive and then, only if they are of the same suit. The method of this game does not require a minimum score of 28 as is the case in Fifty Five-Seventy (55-70) Roman Stud I.

The game Roman Pleasure is very similar to Fifty Five-Seventy (55-70) Roman Stud II with the significant difference that, A. Roman Pleasure is not a gambling game, B. Is designed to be played at home or in any other friendly environment.

C. Does not require a dealer.

D. Is played with special designed paper chips.

E. Is designed without Super Jackpot.

The present invention provides novel playing card games using a new set of cards, having different values and different suits. The cards already have established face values in order not to confuse the player(s) during the game.

All of the above games will help to develop the mathematical skills without the help of a calculator. All the suits of the cards used to play the above games can be also designed having triple, quadruple, quintuple or more, diamonds, hearts, clubs, and spades of any geometrical form. Also the cards can be presented to the player(s) by a dealer, still by a dealer and chosen by the player(s) or by programmed slot machine, computer or computer disk, or any other game device.

In general, the cards used in playing any of the games of this invention may be provided to the players by hand, that is, by a dealer, or by a programmed slot machine or computer or children's game device. Where cards are physically dealt, they may be composed of card stock, plastic, paper, etc.

The preferred embodiment employs cards bearing doubles of the suit indicia, viz, double diamonds, double spades, double hearts and double clubs. However, triples, quadruples, etc., may be used.

DESCRIPTION OF PREFERRED EMBODIMENTS

Turning to the drawings:

FIG. 1 shows the front sides of the 13 double diamond card suit of the novel first card deck of this invention, sometimes hereinafter referred to as the "Roman Deck".

FIG. 2 shows the front sides of the 13 double club card suit of the first deck.

FIG. 3 shows the front sides of the 13 double heart card suit of the first deck.

FIG. 4 shows the front sides of the 13 double spade card suit of the first deck.

FIG. 5 shows the front sides of the 12 double diamond and Joker of the second novel deck of the "Roman Deck" which, in some embodiments of this invention, is used for the Super Jackpot.

FIG. 6 shows the front sides of the 12 double club and Joker of the second novel deck of the "Roman Deck" and is used for the Super Jackpot.

FIG. 7 shows the front sides of the 12 double heart and Joker of the second novel deck of the "Roman Deck" and is used for the Super Jackpot.

FIG. 8 shows the front sides of the 12 double spade and Joker of the second novel deck of the "Roman Deck" and is used for the Super Jackpot.

FIG. 9 shows the backs sides of the two decks of cards shown in FIGS. 1 to 8.

FIG. 10 shows in top view the paying table used in Fifty Five-Seventy (55-70) Roman Stud I which is one of the card game embodiments of this invention.

FIG. 11 is a diagram of the order of play for Fifty Five-Seventy (55-70) Roman Stud I.

FIG. 12 is a diagram of the order of play for Fifty Five-Seventy (55-70) Roman Stud II which is another card game embodiment of this invention.

FIG. 13 shows the design of the paper chips used to play Roman Pleasure which is yet another card game embodiment of this invention.

The following discussion describes three novel card games to be played in different circumstances with three similar but different rules and regulations as follows:

A. Fifty Five-Seventy (55-70) Roman Stud I.

B. Fifty Five-Seventy (55-70) Roman Stud II.

C. Roman Pleasure.

Description Of The Roman Deck Of Cards

The Roman Deck of Cards are especially designed to play the games Fifty Five-Seventy (55-70) Roman Stud I, II and the Roman Pleasure. The size of the cards reflect the size of the standard deck used to play Poker. Two different decks of cards compose the Roman deck as follows: The first deck is composed of 52 cards and four different suits. The four suits are designed to be similar but different from the regular deck used to play poker and are the following: Double spades, double heart, double clubs, double diamonds. Each suit contains 13 cards as follows: 5 cards with values of 10 each, and 8 cards with values from 0, 12, 13, 14, 15, 16, 18, 21. The Roman Deck of Cards are very easy to read and understand. The description of the faces of the cards are as follows:

A. The faces of the cards value 0's are designed with a rectangle, and it is cut by a diagonal line starting from the top right corner to the left bottom corner. At the inside center of the rectangle is a drawing of a large 0 with leaves designed to reflect the old Roman decoration. At the inside of the zero is a drawing of an upside down horse body with the heads. At the inside top left corner and at the inside bottom right corner there are designed larger suits of the card. Outside the rectangle at the same position as above are designed the smaller suits of the card and above the number cards values in arabic numbers.

B. The faces of the cards values of 10, 12, 13, 14, 15, are designed with a rectangle and it is cut by a diagonal line starting from the top right corner to the left bottom corner. At the inside top left corner and at the inside bottom right corner are designed the larger suits of the cards and the value of the card expressed in roman numerals as follows: values of 10=X, value of 12=XII, value of 13=XIII, value of 14=XIV, value of 15=XV.

Outside the rectangle, approximately at the same position as above, are designed the smaller suits of the cards and above the cards values express in arabic numbers.

C. The faces of the cards value 16, 18, 21 also are designed with a rectangle and in them are drawing figures. The drawings are placed at the top right corner and at the bottom left corner of the rectangle. Below the 2 drawings are located the value of the cards expressed in Roman numbers, and at the left top corner and at the bottom right corner of the rectangle are placed the larger suits of the cards. Outside of the rectangle approximately the same position of suits, are designed 2 smaller suits and above them the cards values expressed in Arabic numbers.

The drawing of the faces of the cards value 16, 18, 21 are the following:

A. Cards values 16 bears a drawing representing a Roman Centurion.

B. Cards values 18 bears a drawing representing a Roman Empress.

C. Cards values 21 bears a drawing representing a Roman Emperor and the value expressed in Roman number as follows: XVI for 16, XVIII for 18, and XXI for 21. The Roman cards have only one Emperor/King, Empress/Queen and Centurion/Jack for the four suits.

The Jackpot/Super Jackpot and when a player qualifies for it as discussed further below and requires a second deck as shown in FIGS. 5 to 8. The second deck has 52 cards with 4 suits, printed on different color card stock. Each suit contains 8 cards with a value of 10 each, 4 cards with values of 15, 16, 18, 21 and a Joker.

The suits are the same as the first deck. The description of the face of the cards values 10's, 15's, 16's, 18's, 21's is the same as the first deck. The Joker is a drawing representing a horse body with two heads. Above the two horses heads is a drawing of a jester.

Description Of The Playing Table

The playing table is of the standard size of the common casino playing table. The playing table has an half circle perimeter and it is closed by an horizontal line at the opposite side of the circle creating a place for the required dealer. The table on top is flat and the surface is covered with a special table cloth, appropriately designed to satisfy all the requirements from the Rules and Regulations of the present invention in order to play this game as follows. As shown in FIG. 10, a prospective drawing of the Playing Table is indicated generally by numeral 1. The dealer's place is at 2. The playing area has up to seven playing positions 3. The option spot 4 is used to participate in the Jackpot/Super Jackpot. The wagering spot 5 including Ante and Bet per player and extra wagering area per player to be used only when the initial ante reflects the maximum ante permitted. The numerical spot 6 is used to place the card to comply with Rule #5, option B, of the Fifty Five-Seventy (55-70) Roman Stud I, discussed hereinbelow. The area 7 is used to split the deck of card to comply with Rule #5, option C, of the Fifty Five-Seventy (55-70) Roman Stud I. The dealer spot 8 is used to place the dealer cards. The area 9 is used to place the rest of the cards prior of the Bet. The option spot 10 is used for the players to participate in the Ante-Saver Partial Insurance Program. The holding area 11 for the second deck is used in case the Super Jackpot occurs. The designated area 12 is used to place the chips for pay off. The semicircular area 13 is used to show the name of the game. Numeral 14 depicts a drawing of the winning Super Jackpot hand.

All of the above descriptions may be used also to play the games (55-70) "Roman Stud II" and "Roman Pleasure", with the difference of that the playing table may be made of a folder material such as cardboard, paper board, plastic board, or a wood board, etc.

Rules and Regulations of the Game Fifty Five-Seventy (55-70) "Roman Stud I"

1) To play the Roman Stud I requires the following:
   A. The Roman Deck, newly designed cards, and
   B. The Fifty Five-Seventy (55-70) Roman Stud Table, newly designed layout.

2) To play, 2 decks of cards are required as follows. The first deck (FIGS. 1 to 4) is composed of 52 cards, and 4 different suits. Each suit contains 5 cards, each with value of 10, and 8 cards which have values of 0, 12, 13, 14, 15, 16, 18, 21. The above deck of 52 is the primary deck, with which the game will be played. The second deck (FIGS. 5–8) is composed of 52 cards and 4 suits. Each suit contains 8 cards with the value of 10 each and 4 cards with values of 15, 16, 18, 21 each, and a joker. This second one will be used only when a player qualifies for the Super Jackpot.

3) The Fifth Five-Seventy (55-70) Roman Stud I must be played as follows: Player(s) against the casino, or if played at home Player against Player/Dealer.

4) The Fifty Five-Seventy (55-70) Roman Stud I may be played with from one to seven players, plus a dealer or dealer/player.

5) This game offers three possible choices as to the way the cards may be dealt (shuffle machine may be used but not required) at the casino's option as follows:
   A. Three cards dealt straight to the players and three cards to the dealer, directly from the dealer; starting in a row from the left side players to the right side players.
   B. The players may choose the cards as follows:
      The dealer deals 3 cards per player and place them in the assigned players numerical spots on the play table; and 3 cards to self and places the dealer cards in the dealer spot. At this point, the dealer will ask the players, starting from the dealer left side following in a row to the right side which spot number cards he desires as in the following example:
      4 players are seated at the playing table. The dealer deals 3 cards per player and places them in spaced apart locations on the table. Player #1 has the first choice, and he may choose any of the hands. Player #3 has the second choice, and he may choose any of them minus the hand chosen by player #1. Player #5 (Follows #1 and #3) and he may choose any hand minus the hands already chosen by player #1 and player #3. The last player in this example is player #7 who has no choice of cards, and gets the last three cards. The dealer also receives three cards and places them in the dealer's designated spot on the table.

In the alternative, on the surface of the playing table, the numerical spot 6 on which the cards are placed, can also be designated from 1 to 8 (in lieu of 1 to 7). The Rule 5(B) of the game Roman Stud I offers a variation of how the cards may be dealt as follows:

Dealer deals three cards per player(s) and three cards for the dealer and places the cards in the assigned numerical spot 6 (1 to 8) on the playing table. At this point, the dealer asks each player, starting from dealer's left side following in a row to the right side, which spot number cards he desires as in the following example:

assume 4 players seated on the seats numbers 1, 3, 5 and 7. The dealer deals 3 cards per player and places them in players numerical spot numbers 1, 3, 5 , 7 and 8. Player #1 has the first choice, and he may choose any of them 1, 3, 5, 7 or 8. Player #3 has the second choice, and he may choose any of them minus the one chosen from player #1. Player #5 (Follow #1 and #3) and he may choose any of them minus the one already chosen from player number 1, 3 and 5. The dealer receives the last three cards and places them in the dealer's assigned spot according to the description of the playing table.

C. In this third option, the players have the option of choosing the desired cards as follows: Prior to the deal, the dealer will split the deck of cards in half—creating 2 half decks and placing them on the provided designed spot on the play table as -L- per left and -R- per right, the dealer will open the first half deck face down starting from spot -L- towards the left side and continuing with the second half deck from the spot -R- to the right side. Player shall point to the desired cards, indicating or saying left or right. After the player chooses the desired cards the dealer will deal 3 cards in a row starting from the end indicated by a player and places the cards in the provided spot. The dealer also chooses 3 cards and places them in the dealers spot. After, the dealer will remove from the table the rest of the second half-decks and place them in the provided spot.

The player and the dealer must add the value of the cards with the same suit.

6) The player qualifies for the bet only when his minimum scores with the first three cards is from 28 to 55.

7) When the player score is less than 28, the player already lost that hand.

8) If the player score is less than 28 and more than 21 exactly from 27 to 22, the player may apply for the Ante-Saver Partial Insurance Program (see attached Ante-Saver Partial Insurance Program).

9) The value of the card -0- is ½ point only in the circumstances when dealer and players scores are the same, as in the following example:

A. Dealer score is 18, 21=39

B. Player score is 0, 18, 21=39

In the above example, the player will win because the -0- will have the value of ½ point.

10) The maximum a player may score is 55.

11) The player wins when player's score exceeds the dealer's.

12) The Fifty Five-Seventy (55-70) Roman Stud I is designed with a Jackpot and a Super Jackpot.

13) To qualify for it the player must contribute with a chip to the Jackpot/Super Jackpot funds.

14) A player qualifies for the Jackpot with a score from 49 to 55, and does not need to beat the dealer.

15) A player(s) qualifies for a portion of the Super Jackpot only with scores of these combinations:

| | | | |
|---|---|---|---|
| 10-18-21 = 49 | 13-15-21 = 49 | 12-16-21 = 49 | 15-16-18 = 49 |
| 13-18-21 = 52 | 15-16-21 = 52 | 15-18-21 = 54 | 16-18-21 = 55 |

16) When a player scores one of the above combinations (see rule #15), player will qualify for a 4th card from the second deck.

17) The player wins a portion of the Super Jackpot when the fourth card value which adding to the first three cards is totaling of 70.

18) A player qualifies for the total Super Jackpot only with the score of the following combination: 16–18–21=55.

19) When a player scores the above combination (see Rule #18), player will qualify for a 4th card from the second deck.

20) A player wins the total Super Jackpot only when the fourth card is a joker of the same suit.

21) When a player and the dealer score the same, the tie may be broken by the highest value of the third card. If the third card is the same for each, no one wins.

22) When player and dealer score the same, the player will receive back the full bet, but the player will not receive back the portion of the money allocated for Jackpot and Super Jackpot funds.

23) In case of a Jackpot winner, the player will receive the full amount, depending on the number scored, from 49 to 55. (See suggested payout schedule).

24) In the case of multiple Jackpot winners in one dealing, with the same or different scores, the amount will be split starting from the lowest to the highest, as shown in the suggested example below. The winner's scores are: 2 players with score of 49, 1 player with score of 53, and 1 player with score of 55.

Suggested Payout Example: Total Jackpot/Super Jackpot $100,000
(May vary to the Casino Description)

| | | |
|---|---|---|
| 2 players total 49 | *win $100 each | Amt. Rec. $200.00 |
| 1 player totals 53 | win 2.5% of remaining JP | $2,495.00 |
| 1 player totals 55 | **win 100% of remaining JP | $97,305.00 |

*Per separate schedule of payouts
**or less if a multiple jackpot

25) In the case of multiple Super Jackpot winners in the same deal the Super Jackpot will be split in equal parts.

26) The total of the Jackpot and Super Jackpot may be disclosed to the player with an electronic meter or with a fixed daily amount adding every day the portions of the funds allocated to the Jackpot/Super Jackpot.

27) The dealer does not have any choice to pass. The dealer must always play.

28) The casino can change the deck of cards periodically, for example, every hour. The second deck can be changed any time a Super Jackpot occurs.

The Ante-Saver Partial Insurance Program

1) This game offers a partial insurance program called the Ante-Saver which is designed to save the initial Ante only for the players that do not qualify for the bet.

2) The Ante-Saver Partial Insurance Program is not an obligation but is an option for the players, and apply to this game only when a player total is from 22 to 27.

3) The Ante-Saver Program is always at the only risk of the player.

4) When a player applies for it, he must do two things as follows:

A. Show the scores to the dealer, and

B. Purchase the program from a dealer placing a small rate fee in the assigned spot I on the playing table as follows:

1. One dollar amount for the players that plays the initial ante less of the maximum initial ante permitted or, 2. 10% of the maximum Ante permitted when a player plays an amount equal of the maximum initial Ante permitted.

5) When a player does so, the dealer does not remove the initial Ante from the player that applies for it.

6) The dealer shows the dealer scores.

7) If the dealer's score is from 22 to 27 the player qualifies for the benefit of this program and he will save the initial Ante.

8) If the dealer's score is not from 22 to 27 the player does not qualify for the benefit of this program and he will lose the initial Ante.

9) The player will apply and qualifies for the benefit of this program only when player and dealer scores are from 22 to 27.

10) The Ante-Saver Partial Insurance Program is an option rule and applies to the game only when permitted by a casino and should not effect the involvement of the game.

How To Play Fifty Five-Seventy (55-70) Roman Stud I

1) The Roman Stud is directed by a dealer.

2) To be a player in this game, the participant must just do 2 things:

a) option to contribute a chip for the Jackpot.

b) ante a chip to open the game.

3) When the player does so, the dealer deals 3 cards per player and 3 cards to the dealer.

4) The player must score a minimum of 28 to continue to play.

5) If the player's score is less than 28, he is out and has lost that hand.

6) If the player's score is less than 28 and more than 21 exactly from 27 to 22 the player may apply for the Ante-Saver Partial Insurance Program (see attached Ante-Saver Partial Insurance Program).

7) If the player decides to continue to play, he must add an amount double the initial ante and put the cards face down.

8) If the player, opens the game with the maximum ante, and he decides to continue to play, he has the option to choose to bet an amount double, triple, quadruple, or quintuple the initial ante.

9) If the player scores less than the dealer, the player loses, and the dealer, will remove the player's money and cards. If the player scores more than the dealer, the player wins and will receive from the dealer the exact amount depending on the score (see suggested payouts schedule).

10) At this point this hand is over.

When The Player Wins And Suggested Winning Amount

1) The player(s) wins when he beats the dealer.

2) When the player beats the dealer and the score #s are as follow, the player will win:

A. score from -28 to 38-, the player will win one time the ante, and one time the double or triple or quadruple or quintuple ante.

B. score from -39 to 47-, the player will win one time the ante and 2 times the double or triple or quadruple or quintuple ante.

C. score from -48 to 52-, the player will win one time the ante and 3 times the double and triple or quadruple or quintuple ante.

D. score from -53 to 54-, the player will win one time the ante, and 5 times the double or triple or quadruple or quintuple ante.

E. score of -55-, the player will win one time the ante, and 10 times the double or triple or quadruple or quintuple ante.

When The Player Qualifies And Wins The Jackpot And Super Jackpot With A Suggested Amount 1) To qualify for the Jackpot/Super Jackpot the player must contribute a chip for Jackpot/Super Jackpot Funds.

2) To win the Jackpot and Super Jackpot, the player does not need to beat the dealer.

3) A player wins the Jackpot with scores ranging from 49 to 55, (see suggested payout schedules).

4) To qualify for a portion of the Super Jackpot, the player must total one of the following combinations with the same suit:

| | | | |
|---|---|---|---|
| 12-16-21 = 49 | 10-18-21 = 49 | 13-15-21 = 49 | 15-16-18 = 49 |
| 13-18-21 = 52 | 15-16-21 = 52 | 15 18 21 = 54 | 18-18-21 = 55 |

After scoring one of the above combinations, the player receives from a dealer a fourth card from the second deck.

5) If the fourth card is of the same suit which adding the value to the first three cards is totaling of 70, the player wins a portion of the Super Jackpot.

6) To qualify for the total Super Jackpot the player must score only the following combination: 16–18–21=55. After scoring the above combination, the player receives from the dealer a fourth card from the second deck.

7) If the Fourth card is a Joker of the same suit, the player wins the total Super Jackpot.

8) A single player may be a multiple winner. The same hand may win a Jackpot and a Super Jackpot.

9) When a player wins the Super Jackpot, after winning a Jackpot, and if the player beats the dealer with the first 3 cards, he also wins many times an additional amount totaling to a multiple of the ante depending on the players score (see suggested payout schedule).

10) In the case of a Multiple Super Jackpot winners in one dealing, with the same score, the amount will be split in equal parts.

11) In the case of a Multiple Super Jackpot winners in one dealing with different scores, the amount will be split starting from the lowest score to the highest score.

12) The flow of play is shown diagrammatically in FIG. 11.

SUGGESTED PAYOUT SCHEDULE (May vary) Winning Card Combination Per Suit, From 28 to 55, Jackpot and Super Jackpot

| Suggested profit of multiple (ante & | Winning score if the player score exceeds | Super Jackpot Area★★ J 16 18 21 Super Jackpot<br>To Qualify for the Total Super Jackpot a player must score only this combination: 16-18-21=55<br>To Qualify for a portion of the Super Jackpot, a player must score one of the following combinations: |
|---|---|---|

-continued

SUGGESTED PAYOUT SCHEDULE (May vary) Winning Card Combination Per Suit, From 28 to 55, Jackpot and Super Jackpot

| bet) vs. score | the dealer | ★★ | 10-18-21 15 16 21 | 13-15-21 15 18 21 | 12 16 21 16 18 21 | 15 16 18 | 13 18 21 | | | | | | | | | | | | | | | |
|---|---|---|---|---|---|---|---|---|---|---|---|---|---|---|---|---|---|---|---|---|---|---|
| 10 | 55 | Jackpot Area | | | — | 16 | 18 | 21 | — | | | | | | | | | Jackpot Area | | 100% | | |
| 5 | 54 | ★ | | | | 15 | 18 | 21 | | | | | | | | | | | | 5% | | |
| 5 | 53 | ★ | | | | 14 | 18 | 21 | | | | | | | | | | | | 2.5% | | |
| 3 | 52 | ★ | | | 15 | 16 | 21 | — | 13 | 18 | 21 | | | | | | | | | $300 | Suggested | |
| 3 | 51 | ★ | | | 14 | 16 | 21 | — | 12 | 18 | 21 | | | | | | | | | $300 | Jackpot Pay-off | |
| 3 | 50 | ★ | | | 13 | 16 | 21 | — | 14 | 15 | 21 | | | | | | | | | $300 | | |
| 3 | 49 | ★ | 10 18 21 | — | 15 | 16 | 18 | — | 12 | 16 | 21 | — | 13 | 15 | 21 | | | | | $100 | | |
| 3 | 48 | | 12 | 15 | 21 | — | 13 | 14 | 21 | — | 14 | 16 | 18 | | | | | | | | | |
| 2 | 47 | | 14 15 18 | — | 13 | 16 | 18 | — | 10 | 16 | 21 | — | 12 | 14 | 21 | | | | | | | |
| 2 | 46 | | 13 15 18 | — | 12 | 13 | 21 | — | 10 | 15 | 21 | — | 12 | 16 | 18 | | | | | | | |
| 2 | 45 | | 12 15 18 | — | 13 | 14 | 18 | — | 10 | 14 | 21 | — | 14 | 15 | 16 | | | | | | | |
| 2 | 44 | | 13 15 16 | — | 12 | 14 | 18 | — | 10 | 13 | 21 | — | 10 | 16 | 18 | | | | | | | |
| 2 | 43 | 13 | 14 16 — | 12 | 13 | 18 | — | 12 | 15 | 16 | — | 10 | 12 | 21 | — | 10 | 15 | 18 | | | | |
| 2 | 42 | | 12 | 14 | 16 | — | 10 | 14 | 18 | — | 13 | 14 | 15 | | | | | | | | | |
| 2 | 41 | | 10 10 21 | — | 10 | 13 | 18 | — | 10 | 15 | 16 | — | 12 | 13 | 16 | — | 12 | 14 | 15 | | | |
| 2 | 40 | | 10 | 14 | 16 | — | 12 | 13 | 15 | — | 10 | 12 | 18 | | | | | | | | | |
| 2 | 39 | | — 18 21 | — | 0 | 18 | 21 | — | 10 | 13 | 16 | — | 12 | 13 | 14 | — | 10 | 14 | 15 | | | |
| 1 | 38 | | 10 | 10 | 18 | — | 10 | 13 | 15 | — | 10 | 12 | 16 | | | | | | | | | |
| 1 | 37 | | — 16 21 | — | 0 | 16 | 21 | — | 10 | 13 | 14 | — | 10 | 12 | 15 | | | | | | | |
| 1 | 36 | | — 15 21 | — | 0 | 15 | 21 | — | 10 | 10 | 16 | — | 10 | 12 | 14 | | | | | | | |
| i | 35 | | — 14 21 | — | 0 | 14 | 21 | — | 10 | 10 | 15 | — | 10 | 12 | 13 | | | | | | | |
| 1 | 34 | | — 16 18 | — | | 13 | 21 | — | 0 | 16 | 18 | — | 0 | 13 | 21 | — | 10 | 10 | 34 | | | |
| 1 | 33 | | — 15 18 | — | | 12 | 21 | — | 0 | 15 | 18 | — | 0 | 13 | 21 | — | 10 | 10 | 13 | | | |
| 1 | 32 | | | | | 14 | 18 | — | 0 | 16 | 18 | — | 10 | 10 | 12 | | | | | | | |
| 1 | 31 | | 13 18 | — | 15 | 16 | — | 10 | 21 | — | 0 | 15 | 16 | — | 0 | 13 | 18 | — | 0 | 10 21 | | |
| 1 | 30 | | 14 16 | — | 0 | 14 | 16 | — | 10 | 10 | 10 | — | 12 | 18 | — | 0 | 12 | 18 | | | | |
| 1 | 29 | | | | | 13 | 16 | — | 14 | 15 | — | 0 | 13 | 16 | — | 0 | 14 | 15 | | | | |
| 1 | 28 | | 13 15 | — | 0 | 13 | 15 | — | 10 | 18 | — | 0 | 10 | 18 | — | | | | | | | |
| | | | Ante-Saver Insurance Area | | | | | | | | | | | | | | | | | | | |
| | 27 | | 12 15 | — | 0 | 12 | 15 | — | 0 | 13 | 14 | — | 13 | 14 | | | | | | | | |
| | 26 | | 10 16 | — | 0 | 10 | 16 | — | 0 | 12 | 14 | — | 12 | 14 | | | | | | | | |
| | 25 | | 10 15 | — | 0 | 10 | 15 | — | 0 | 12 | 13 | — | 12 | 13 | | | | | | | | |
| | 24 | | 10 14 | — | 0 | 10 | 14 | — | | | | | | | | | | | | | | |
| | 23 | | 10 13 | — | 0 | 10 | 13 | | | | | | | | | | | | | | | |
| | 22 | | 10 12 | — | 0 | 10 | 12 | | | | | | | | | | | | | | | |

★★ ONLY the Highlight combinations qualify for the Super Jackpot.
★ The Highlight combinations from 49 to 55 qualify for the Jackpot.

In summary, one preferred embodiment of the present invention comprises a method of playing a card game (Fifty Five-Seventy (55-70) Roman Stud I) with the decks of cards previously described. The option to participate to a Jackpot/Super Jackpot and an ante is made prior to the examination of any card, and comprises the steps of:

A. Forming players and dealer hands each containing three cards to be dealt from the following three options:
   1. Dealer will deal three cards per player and three cards to self, or
   2. Player(s) choose own cards as described in Rule 5B without changing the dealer hand, or
   3. Player(s) and dealer choose own cards according to Rule 5C.

B. Each player(s) examines his hand and totals the values of the cards of the same suit.

C. Eliminating from betting any player having total of less than 28, and

D. Qualifying those player(s) having the totals from 22 to 27 for the Ante-Saver Partial Insurance Program, and E. Eliminating from the game any player having total of less than 21.

F. Declaring winners only those player(s) having a total of 28 or more exceeding the dealer's total.

G. Qualifying for the Super Jackpot only those player(s) having a score of 49, 52, 54, 55.

The score of 28 which allows the player(s) qualify for the betting in the game Fifty Five-Seventy (55-70) Roman Stud I can be changed to various numbers ranging from 10 to 55.

The score ranging from 22 to 27 which qualifies the player(s) for the Ante-Saver Partial Insurance Program in the game Fifty Five-Seventy (55-70) Roman Stud I can be changed to various numbers from 10 to 55.

Rules And Regulations Of The Game Fifty Five-Seventy (55-70) Roman Stud II

1) This game must be played only with the first Roman Deck, newly designed cards with different suits and card values. The values of the cards are additive only to the cards of the same suit.

2) The value of the card #0 is ½ point only in the circumstance when players scores are the same, as in the following example:
   Player "A" total 18, 21=39
   Player "B" total 0, 18, 21=39½.

In the example above, the Player "B" will win because the 0 has the value of ½ point.

3) The Fifty Five-Seventy (55-70) Roman Stud II does not require a minimum score, and may be played in any of the playing table because it does not require any special layout.

4) The Fifty Five-Seventy (55-70) Roman Stud II is played as follows: Player against player.

5) To play is possible from 2 to 10 players plus a dealer.

6) The dealer will never play, his job is to deal the cards and conduct and control the game.

7) This game is played with 5 cards dealt to each player from a dealer.

8) Maximum 3 of the 5 cards are additive to themselves with the same suit.

9) For start, each player must participate with an ante to open the game.

10) The initial ante will be divided in three parts as follows:

A. a percentage payoff to the casino service (may vary from casino to casino).

B. percentage for Jackpot/Super Jackpot funds (may vary from casino to casino).

C. pot for player for that hand.

11) When the player does so, the dealer deals the first 2 cards per each player, one face up and one face down. Bet will begin.

12) To start the bet, the player with the lowest card value face up following in row to other players from the left to the right.

13) A player may choose to bet or to pass or say "chip".

14) If a player passes he loses and he is out from that hand. If a player chooses a chip he may continue to play only when all the players choose the same chip.

15) To continue to play, the player participates with a bet, or raises up to 4 times of the initial bet.

16) When the player does so, he will receive from the dealer a third card face up.

17) After the third card, will start the bet, the player with the highest score from the cards face up.

18) After the third card a player may choose to bet or to pass.

19) If a player passes, he loses and he is out from that hand.

20) To continue to play, see rule #16 above.

21) When player does so, will receive from the dealer a fourth card face up.

22) The same of rule #18 above.

23) The same of rule #19 above.

24) The same of rule #16 above.

25) When a player does so, will receive from the dealer a fourth card face down.

26) Will begin the bet, the player with the highest total from the three card face up.

27) A player wins, when player scores exceed other players.

28) When two or more player scores are the same, the tie may be broken by the highest values of the 4th and 5th card. If the fourth and fifth cards are the same, the pot will be split in equal amounts per each player. The hand is over.

29) The Roman Stud II is designed with Jackpot and Super Jackpot.

30) When a player scores from 49 to 55 and he is exceeded by another player's score will qualify and win the Jackpot.

31) Only the two players with the highest scores will win the Jackpot.

32) To qualify for a Super Jackpot the player does not need to exceed other player's scores.

33) To qualify for the Super Jackpot the player must score only the combination with the same suit as follows:
15, 16, 18 =49 or 15, 16, 21=52 or
15, 18, 21=54 or 16, 18, 21=55

34) When a player's score is one of the above combinations (see rule #33) and he exceeds or he is exceeded by other players scores, he will win the Jackpot and will qualify for the Super Jackpot and receive a fourth card from a second deck.

35) The player wins a portion of the Super Jackpot fund when the fourth card value, which adding to the first three cards is totaling of 70.

36) A player wins the Total Super Jackpot when the fourth card is a Joker.

37) In the case of a multiple Jackpot or Super Jackpot, the amount is split starting from the lowest to the highest.

38) A single player may be a multiple winner. The same hand may win a Jackpot and Super Jackpot.

39) When a player wins the Super Jackpot, after winning a Jackpot and if the player beats other players, he also wins the pot for that hand.

40) At this point the hand is over.

41) The Casino must change the deck of cards every hour. The second deck must be changed any time a Super Jackpot occurs.

How To Play The Game Fifty Five-Seventy (55-70) Roman Stud II

1) This game is played with 5 cards dealt to each player from a dealer as follows: First card face down, second, third, and fourth cards face up and fifth face down.

2) To play, the player must contribute with an ante to participate to open the game.

3) When the player does so, will receive the first 2 cards from the dealer; the first face down, and the second face up.

4) To start the bet, the player with the lowest card value may choose from the following: bet, pass or chip.

A. When a player chooses to pass, he is out of the hand, and he lost the ante.

B. When the player chooses to do chip is still in the game, and he may re-enter in that hand any time any other player chooses to bet.

C. When the player chooses to bet, he qualifies for the next card.

5) Rule #4 including options A, B, and C will repeat from the second, third, fourth and fifth cards per each hand.

6) To win the pot, the player that scores the highest values with three of the five cards—wins.

7) The flow of play is presented diagrammatically i FIG. 12.

Rules And Regulations Of The Game Roman Pleasure

1) The Roman Stud Pleasure is a game that may be played in the family or with a friend at home or in any other friendly environment, such as a Senior Citizen Center. It will help to develop your mathematical skills without the help of a calculator.

2) The game is played with the Roman deck, newly designed cards with different card values. The value of the cards are additive only to the cards of the same suit.

3) To play also requires paper chips with point values as follows:
10 chips with values of 30 points
30 chips with values of 10 points
40 chips with values of 5 points
50 chips with values of 2 points
100 chips with values of 1 point 4) The Roman "Pleasure" may be played with from 2 to 10 players.

5) The players will divide in equal parts the paper chips as follows: 1 chip of 30 points; 3 of 10; 4 of 5; 5 of 2; 10 of 1 point each.

6) Each player will deal the cards in rotation to each other, from left to right.
7) The Roman Pleasure is played with 5 cards dealt to each player, but only the best of 3 of the 5 are additive to themselves with the same suits.
8) To play, each player must open the game with an ante of 3 points.
9) A player wins when the player scores more than any other player.
10) The maximum that may be scored is 55.
11) If one or more players score the same they will divide the winning points in equal parts.
12) We recommend to set a time in the beginning as to when the game will end.
13) When a player loses all his/her chips, he/she is out of the game.
14) The ante of 3 points to open the game is divided as follows:
A. 2 points per player/or that hand; and
B. 1 point each is placed on the side for the jackpot.
15) The player wins a portion or the total jackpot only when the scores are the following:
15, 16, 18=49 win 10% share
15, 16, 21=52 win 20%
15, 18, 21=54 win 50%
16, 18, 21=55 win 100%
16) If a player's score is one of the above combinations of the rule #15 and the score is more than any of the other players, this player will win the hand plus the jackpot.
17) If 2 or more players score the same jackpot combination, the amount related to that score will be divided into equal parts.

How To Play And Win The Roman Pleasure

1) To play Roman Pleasure it requires a minimum of 2 to a maximum of 10 players.
2) The players must first divide in equal parts the paper chips.
3) After they do so, they must choose a player/dealer to start to deal the cards.
4) At this point each player must participate with an ante of paper chips totaling 3 points for the following:
A. 2 points for the hand, and
B. 1 point for the jackpot fund. (The jackpot fund will accumulate hand-after-hand since the players score the jackpot combinations; (see Rules and Regulations).
5) Then the player/dealer deals 5 cards to the players and 5 cards to self. Each player must choose to pass or to play, starting from the player at the left side of the dealer/player in rotation to the right side to the dealer/player.
6) If a player chooses to pass, the hand is over.
7) If the player chooses to play, he must bet a chip, from 2 to 5 points maximum. If other players also choose to play they must match the second bet of the first player. The winner is the player who scores the most with 3 of the 5 cards additive only within the same suit. If the score is a tie the bet will be divided in equal amounts to the players that scored the same maximum total. If a player scores a jackpot and the score is more than any other player, he/she will win the bet plus a portion or the total jackpot (depending on the score). If 2 or more players have the same jackpot total; the portion of the total amount allocated to the jackpot will be split in equal parts.
8) At this point, the hand is over.
9) At the end, the one with the most points—wins.

Description Of The Paper Chips To Play The Roman Pleasure

The design of the paper chips to play the Roman Pleasure, shown in FIG. 13 are to reflect the style and the decoration of the Old Roman Empire. The size of the chips are approximately 2×4 inches and the outside border is designed with a drawing of leaves. The inside is designed with a drawing of an oval circle in leaves and at the inside of the oval circle, the values of the chips expressed in Roman numerals. Drawing of two columns are at each side of the oval circle and at the top and at the bottom left and right side of the columns are designed the values of the chips expressed in Arabic numerals.

The values of the chips are as follows:

Chips Value with 1 point
Chips Value with 2 points
Chips Value with 5 points
Chips Value with 10 points
Chips Value with 30 points Having fully described the invention, it is intended that it be limited only by the lawful scope of the appended claims.

I claim:

1. A method of playing a card game with a deck of cards composed of 52 cards and 4 suits, the suits being multiple hearts, multiple spades, multiple diamonds and multiple clubs, each suit containing 13 cards bearing one of the values 0, 10, 11, 12, 13, 14, 15, 16, 17, 18, 19, 20 and 21, said cards being face value except cards bearing one of the numbers 11, 17, 19 and 20 which have a value of 10 each per suit, said values of the cards being additive only if the cards are of the identical suit, an opening ante being made prior to viewing of any card, comprising the steps of:

A. forming dealer and player hands each containing three cards;
B. each player examining the hand held and totaling the value of the cards of the identical suit;
C. eliminating any player having a total of less than 28; and
D. declaring winners only those remaining players having a total of 28 or more and exceeding the dealer's total.

2. The method of claim 1 wherein the hands are provided by a dealer or a machine or a computer or game device.

3. The method of claim 1 wherein the hands are dealt by a dealer directly to each player.

4. The method of claim 1 wherein the dealer establishes the dealer hand plus as many three card player hands as there are players and allows each player in any desired order to select a player hand.

5. The method of claim 1 wherein the game is played on a playing table and prior to the deal, the dealer splits the deck of cards in half—creating 2 half decks and places said half decks on a provided designed spot on said playing table as -L- per left and -R- per right, the dealer opens the first half deck face down starting from spot -L- towards the left side and continuing with the second half deck from the spot -R- to the right side, the player points to the desired cards, indicating or saying left or right, and after the player chooses the desired cards, the dealer deals 3 cards in a row starting from the end indicated by a player and places the cards in the provided spot.

6. The method of claim 1 wherein the card game is played on a curvilinear table with the dealer's position on the diametrically linear side, and the players positions (up to 7) located around the curvilinear side.

7. The method of claim 1 wherein:

A. the game offers a partial insurance program which is designed to save the opening ante only for the players that do not qualify for the bet;

B. the said insurance program is not an obligation but is an option for the players, and apply to this game only when a player total is from 22 to 27;

C. the said program is at the risk of the player;

D. when a player applies for said insurance program, said player must do two things as follows:

1. show the cards to the dealer, and
2. purchase the program from the dealer with a small rate fee as follows:
   a. one dollar amount for the players that plays the opening ante less of the highest opening ante permitted, or
   b. 10% of the highest Ante permitted when a player plays an amount equal of the highest opening ante permitted;

E. when a player does so, the dealer does not remove the opening ante from the player that applies for said insurance program;

F. the dealer shows the dealer scores;

G. if the dealer total is from 22 to 27 the player qualifies for the benefit of said insurance program and that player will save the opening ante;

H. if the dealer's total is not from 22 to 27 the player does not qualify for said insurance program and will lose the opening ante; and I. the player applies and qualifies for the benefit of said insurance program only when player and dealer totals are from 22 to 27.

8. The method of claim 1 wherein the player(s) have total(s) of at least 28 continues to play by at least doubling the opening ante and placing the cards face down, if the player totals more than the dealer, the player wins and receives a payout.

9. The method of claim 8 wherein when the player beats the dealer and totals as follows, the player wins:

A. total from -28 to 38-, the player will win one time the opening ante, and one time the double or triple or quadruple or quintuple ante.

B. total from -39 to 47-, the player will win one time the opening ante and 2 times the double or triple or quadruple or quintuple ante.

C. total from -48 to 52-, the player will win one time the opening ante and 3 times the double or triple or quadruple or quintuple ante.

D. total from -53 to 54-, the player will win one time the opening ante, and 5 times the double or triple or quadruple or quintuple ante.

E. total of -55-, the player will win one time the ante, and 10 times the double or triple or quadruple or quintuple opening ante.

10. The method of claim 1 wherein before viewing the cards held, any player choosing to contribute a chip to a Jackpot and such player(s) with totals ranging from 49 to 55 win even if the total is less than the dealers total.

11. The method of claim 10 wherein any player qualifies for a Super Jackpot by one of the following combinations from the same suit:

| | | | |
|---|---|---|---|
| 12-16-21 = 49 | 10-18-21 = 49 | 13-15-21 = 49 | 15-16-18 = 49 |
| 13-18-21 = 52 | 15-16-21 = 52 | 15 18 21 = 54 | 16-18-21 = 55; |

and after scoring one of said combinations, the player receives from a dealer a fourth card from a second deck, said second deck having 52 cards with 4 suits, each suit contains 8 cards with a value of 10 each, 4 cards with values of 15, 16, 18, 21 and a Joker, the suits being the identical as the first deck, if the fourth card is of the identical suit and the value of which is such that when added to the first three cards, the resulting total is 70, the player wins a portion of said Super Jackpot.

12. The method of claim 11 wherein a play qualifies the for said Super Jackpot by scoring only the following combination: 16–18–21=55, and upon scoring said combination, the player receives from the dealer a fourth card from the second deck, if the fourth card is a Joker of the identical suit, the player wins said Super Jackpot.

13. A method of playing a card game with a deck of cards composed of 52 cards and 4 suits, the suits being multiple hearts, multiple spades, multiple diamonds and multiple clubs, each suit containing 13 cards bearing one of the values 0, 10, 11, 12, 13, 14, 15, 16, 17, 18, 19, 20 and 21, said cards being face value except for cards bearing one of the numbers 11, 17, 19 and 20 which have a value of 10 each per suit, said values of the cards being additive only if the cards are of the identical suit, option for the players to participate to Jackpot/Super Jackpot and an opening ante being made prior to viewing of any card, giving the players an opportunity to choose an amount from a minimum to a maximum opening ante comprising the steps of:

A. providing an option for a player to participate in a Jackpot/Super Jackpot;

B. participating with an opening ante, choosing an amount from a minimum to a maximum permitted;

C. forming players and dealer hand each containing three cards;

D. each of the player(s) examines the hand held and totals the value of the cards of the identical suit;

E. eliminating from the game any player having a total of 21 or less;

F. qualifying for the said insurance program any player having a total from 22 to 27;

G. qualifying any player having a total of 28 or more for the play with at least doubling the opening ante, and;

H. with the proviso that if any player opens the game with an opening ante equal of the highest ante permitted, that player can choose to bet an amount of triple, quadruple, or quintuple of the opening ante;

I. declaring winner only those players with 28 or more and having a total exceeding the dealer's total;

J. qualifying for the Jackpot only those players having a total from 49 to 55;

K. qualifying for the Super Jackpot only the participating players having a total of 49, 52, 54, 55;

L. resolving winner pay-off.

14. A method of playing a card game with a deck of cards composed of 52 cards and 4 suits, the suits being multiple hearts, multiple spades, multiple diamonds and multiple clubs, each suit containing 13 cards bearing one of the values 0, 10, 11, 12, 13, 14, 15, 16, 17, 18, 19, 20 and 21, said cards being face value except for cards bearing one of the numbers 11, 17, 19 and 20 which have a value of 10 each per suit, said values of the cards being additive only if the cards are of the identical suit, 5 cards being presented to each player as follows: dealing first card face down, second, third, and fourth cards face up and fifth face down, an opening ante being made prior to dealing of any cards, comprising the steps of:

A. each player receiving two cards, the first face down, and the second face up, B. betting starting with the player with the lowest card value having the opportunity of choosing from the following: bet, pass or chip, with the following consequences, 1. any player choosing to pass, is out of the game, and loses the ante,
2. any player choosing to say chip remains in the game, and choose to re-enter in that hand any time any other player chooses to bet,
3. any player choosing to bet qualifies to receive another card, C. presenting additional cards with options 1, 2, and 3 of said betting step, being repeated for the second, third, fourth and fifth cards per each hand, and D. declaring the player that scores the greatest value with three of the five cards the winner of the pot.

15. The method of claim 14 wherein the cards are dealt by a dealer or a machine or a computer or game device.

16. The method of claim 14 wherein the cards are dealt by a dealer directly to each player.

17. A method of playing a card game with a deck of cards composed of 52 cards and 4 suits, the suits being multiple hearts, multiple spades, multiple diamonds and multiple clubs, each suit containing 13 cards bearing one of the values 0, 10, 11, 12, 13, 14, 15, 16, 17, 18, 19, 20 and 21, said cards being face value except for cards bearing one of the numbers 11, 17, 19 and 20 which have a value of 10 each per suit, said values of the cards being additive only if the cards are of the identical suit, comprising the steps of:

A. establishing a source of paper chips having point values as follows:
10 chips with values of 30 points
30 chips with values of 10 points
40 chips with values of 5 points
50 chips with values of 2 points
100 chips with values of 1 point, B. dividing the paper chips among the players in equal parts as follows: 1 chip of 30 points; 3 of 10; 4 of 5; 5 of 2; 10 of 1 point each, C. providing each player the cards, with 5 cards being dealt to each player, but only the greatest value of 3 of the 5 of the identical suit being additive, D. to play, each player opening the game by making an opening ante of at least 3 points, and E. declaring the winner of the game that player scoring more than any other player.

18. The method of claim 17 wherein the cards are dealt by a dealer or a machine or a computer or game device.

19. The method of claim 17 wherein the cards are dealt by a dealer directly to each player.

20. The method of claim 17 further comprising

A. dividing the ante of 3 points to open the game as follows:

1. 2 points per player/or that hand; and
2. 1 point each will set on the side for the jackpot, and B. declaring the player the winner of a portion or 100% jackpot only when the scores are the following:
15, 16, 18=49 win 10% share
15, 16, 21=52 win 20%
15, 18, 21=54 win 50%
16, 18, 21=55 win 100%.

* * * * *